US008992212B2

(12) United States Patent
Hansen

(10) Patent No.: US 8,992,212 B2
(45) Date of Patent: Mar. 31, 2015

(54) TORCH WITH OPERATING DEVICE

(75) Inventor: Lars Hansen, Hosltebro (DK)

(73) Assignee: Lamplight Farms Incorporated, Menomonee Falls, WI (US)

( * ) Notice: Subject to any disclaimer, the term of this patent is extended or adjusted under 35 U.S.C. 154(b) by 1289 days.

(21) Appl. No.: 12/231,819

(22) Filed: Sep. 5, 2008

(65) Prior Publication Data

US 2009/0068608 A1 Mar. 12, 2009

(30) Foreign Application Priority Data

Sep. 7, 2007 (DK) ..... 2007 01284

(51) Int. Cl.
*F23D 3/18* (2006.01)
*F23D 3/24* (2006.01)

(52) U.S. Cl.
CPC ..... *F23D 3/24* (2013.01)
USPC ..... 431/321; 431/322; 431/324

(58) Field of Classification Search
CPC ..... F23D 3/24; F23D 3/32; F23D 3/34
USPC ..... 431/144–152, 319–324, 120, 123, 344; 206/85–95; 126/96, 260
See application file for complete search history.

(56) References Cited

U.S. PATENT DOCUMENTS

| | | | | |
|---|---|---|---|---|
| 203,043 | A | 4/1878 | Hillegass | |
| 243,134 | A | 6/1881 | Hinrichs et al. | |
| 401,075 | A | 4/1889 | Seltzer | |
| 1,121,175 | A | 12/1914 | Dow | |
| 1,684,524 | A * | 9/1928 | Stanczyk | 431/230 |
| 2,122,624 | A | 7/1938 | Sauer | |
| 2,217,970 | A | 10/1940 | Shearman et al. | |
| 2,250,198 | A * | 7/1941 | Hutt | 431/314 |
| 2,313,784 | A | 3/1943 | Then | |
| 2,684,182 | A | 7/1954 | Gey | |
| 2,836,043 | A | 5/1958 | Spethmann | |
| 3,066,515 | A * | 12/1962 | Virtanen | 431/152 |
| 3,364,704 | A | 1/1968 | Bernstein | |
| 3,385,084 | A | 5/1968 | MacDonald | |
| 3,531,228 | A | 9/1970 | Reese | |
| D219,062 | S | 10/1970 | Kozoil | |

(Continued)

FOREIGN PATENT DOCUMENTS

| | | |
|---|---|---|
| FR | 2734888 | 6/1996 |
| JP | 06331133 | 11/1994 |

(Continued)

OTHER PUBLICATIONS

Pipe-Line Denmark, "Elipse Advanced Burning Control", Published at: http://www.monalisa.no/pipeline/pdf/17.pdf.

(Continued)

*Primary Examiner* — Thomas Denion
*Assistant Examiner* — Laert Dounis
(74) *Attorney, Agent, or Firm* — Fellers, Snider, Blankenship, Bailey & Tippens, P.C.

(57) ABSTRACT

A torch includes a tank adapted to contain a fuel, a firebowl atop the tank defining a fill opening, and an operating device that fits over the firebowl as a snuffer. A closing device may be fitted into the fill opening. The closing device may be movable between a lowered closed position and a raised open position. The closing device defines at least one recess for receiving a portion of an operating device that moves the closing device between the open and closed positions.

4 Claims, 7 Drawing Sheets

(56) References Cited

U.S. PATENT DOCUMENTS

| | | | | |
|---|---|---|---|---|
| 3,727,810 | A | 4/1973 | Douty | |
| 4,039,274 | A * | 8/1977 | Nordlinger | 431/128 |
| 4,781,577 | A * | 11/1988 | Stewart | 431/320 |
| 4,792,054 | A | 12/1988 | Weidman | |
| 4,887,960 | A * | 12/1989 | Stewart et al. | 431/146 |
| 5,083,916 | A | 1/1992 | Glennon et al. | |
| 5,127,825 | A * | 7/1992 | Tendick, Sr. | 431/320 |
| 5,205,730 | A | 4/1993 | Capdeville | |
| 5,269,432 | A | 12/1993 | Beckertgis | |
| 5,405,262 | A | 4/1995 | Appel | |
| 5,555,993 | A | 9/1996 | Borkowski et al. | |
| 5,584,283 | A | 12/1996 | Messina | |
| D404,507 | S | 1/1999 | Palmer et al. | |
| 5,902,101 | A | 5/1999 | Palmer et al. | |
| 5,980,241 | A | 11/1999 | Schirneker | |
| 6,010,332 | A | 1/2000 | Lee et al. | |
| 6,015,286 | A * | 1/2000 | Maruyama | 431/130 |
| 6,135,759 | A * | 10/2000 | Gerstenberger | 431/12 |
| 6,290,914 | B1 * | 9/2001 | LeJeune et al. | 422/125 |
| D450,140 | S | 11/2001 | Donley | |
| 6,360,738 | B1 | 3/2002 | Brooks | |
| 6,468,072 | B2 | 10/2002 | Shook | |
| 6,514,070 | B2 * | 2/2003 | Lu | 431/152 |
| 6,663,258 | B1 | 12/2003 | Kanter | |
| 6,663,838 | B1 | 12/2003 | Soller et al. | |
| 6,739,471 | B2 | 5/2004 | Goetz et al. | |
| 6,746,235 | B1 | 6/2004 | Aszenbrenner et al. | |
| 6,780,382 | B2 | 8/2004 | Furner et al. | |
| 6,857,869 | B1 * | 2/2005 | Sun | 431/289 |
| 7,056,113 | B2 | 6/2006 | Bachinski et al. | |
| 7,090,142 | B2 | 8/2006 | Rantzen | |
| 7,156,653 | B1 | 1/2007 | Demars | |
| 7,198,484 | B2 * | 4/2007 | Hart et al. | 431/33 |
| 7,214,055 | B2 * | 5/2007 | Meister et al. | 431/349 |
| 7,232,550 | B1 | 6/2007 | Rodgers et al. | |
| 7,247,017 | B2 | 7/2007 | Furner | |
| 7,303,390 | B2 * | 12/2007 | Heng-Wei | 431/320 |
| 2002/0164554 | A1 | 11/2002 | Kisch et al. | |
| 2004/0229180 | A1 | 11/2004 | Furner | |
| 2006/0057530 | A1 | 3/2006 | Kuricek et al. | |
| 2006/0144599 | A1 | 7/2006 | Leinemann | |
| 2006/0199129 | A1 | 9/2006 | Konkle, Jr. | |
| 2006/0251997 | A1 | 11/2006 | Schulte et al. | |
| 2007/0015097 | A1 | 1/2007 | Baker | |

FOREIGN PATENT DOCUMENTS

| | | |
|---|---|---|
| WO | WO 03106895 | 12/2003 |
| WO | WO 2004108219 | 12/2004 |

OTHER PUBLICATIONS

Pipe-Line Denmark, "The Torch Master Brochure", Published at: http://www.pipe-line.dk/pdf/English2007WEB.pdf.

* cited by examiner

TORCH WITH OPERATING DEVICE

CROSS REFERENCE TO RELATED APPLICATIONS

This application claims priority of Danish Patent Application No. P16831DK00, entitled "TORCH WITH OPERATING DEVICE," filed Sep. 7, 2007, the contents of which are hereby incorporated by reference.

FIELD OF THE INVENTION

This disclosure relates to liquid fueled torches in general and, more specifically, to liquid fueled torches with a wick.

BACKGROUND OF THE INVENTION

Liquid fueled torches may be utilized for a number of purposes such as decorative lighting and dispersing scented oils. Liquid fueled torches may also be used to disperse insect repellant oils and/or chemicals.

Liquid fueled torches may be reusable and refillable. However, the refilling operation may necessitate the handling of dirty or sooty components. Additionally, when the refueling operation requires removal of a wick holding component, the potential for coming into contact with the torch fuel via the wick is increased. The problem can be exacerbated by the fact that users often refill torches just prior to use, when it may not be convenient to have to clean soot or fuel from the hands.

Ensuring that the torch is properly reassembled can also be problematic. Owing to the unpleasant nature of refilling a torch, various components may not be reassembled properly. This can be a danger where, for example, a wick holder or fuel port is not properly refastened or closed. A fuel spill could result in this case which could also create a fire hazard if the torch is operational.

What is needed is a device for addressing the above and related issues.

SUMMARY OF THE INVENTION

The present invention disclosed and claimed herein, in one aspect thereof, comprises a torch. The torch includes a tank adapted to contain a fuel, a firebowl atop the tank defining a fill opening, and an operating device that fits over the firebowl as a snuffer. A closing device may be fitted into the fill opening. The closing device may be movable between a lowered closed position and a raised open position. The closing device defines at least one recess for receiving a portion of an operating device that moves the closing device between the open and closed positions. Some embodiments may have a spring that biases the closing device toward the open position such that the closing device rises upon being urged toward the open position.

In some embodiments, the torch includes at least one protrusion extending inwardly from an interior wall of the fill opening, and at least one protrusion extending outwardly from the closing device. The at least one protrusion on the fill opening meshes with the at least one protrusion on the fill device to selectively retain the closing device in the closed position. A stopper may be mounted around a portion of the closing device. The stopper seals an interior of the tank when the closing device is in the closed position. A spring acting against the stopper to bias the closing device toward the open position may also be provided. The closing device may be removable from the fill opening, and the tank may be adapted to contain a liquid fuel.

The closing device may further comprise a wick holder. An outer diameter of the wick holder may be less than an inner diameter of the fill opening. A stopper may be provided along a portion of the wick holder such that the stopper seals the tank when the closing device is in the closed position and is withdrawn from the fill opening when the closing device is in the open position. A spring acting between the stopper and the inner diameter of the fill tube may bias the stopper out of the fill hole.

The present invention disclosed and claimed herein, in another aspect thereof, is a torch comprising a tank defining a fill hole on a top surface thereof, an axle in the top of the tank defining a wick opening, and a closing device selectively rotatable on the axle between an open position and a closed position whereupon the closing device covers the fill hole.

In some embodiments, the torch includes an operating device closable over the top of the tank as a snuffer, the operating device having a projection that interfaces with a mating projection on the closing device to move the closing device between the open and closed positions. The torch may also include a locking cam positioned to retain the closing device in the closed position. The closing device may provide a sealing protrusion on a lower surface thereof that protrudes to seal in the fill hole when the closing device is in the closed position.

The invention of the present disclosure, in another aspect thereof, includes a torch comprising a tank defining a wick holder and a fill hole, a closing device that selectively substantially seals the fill hole when in a closed position, the closing device being operable by a lever external to the tank, and a safety pin biased to prevent opening of the closing device. In some embodiments, the torch comprises an axle interposing the closing device and the external lever, wherein the safety pin meshes with the axle to prevent opening of the closing device. A lid may be fitted to the tank and be operable as a snuffer. The lid disengages the safety pin from the axle when placed on the tank.

In some embodiments, the closing device seals the fill hole from inside the tank. The closing device may further comprises a stopper mounted to an arm, the arm connecting to an axle that meshes with the safety pin such that the safety pin selectively prevents rotation of the axle. The torch may further comprise a lever external to the tank that selectively opens and closes the closing device, and a pin that selectively retains the lever in a closed position.

DETAILED DESCRIPTION OF THE PREFERRED EMBODIMENTS

Figure 1A:
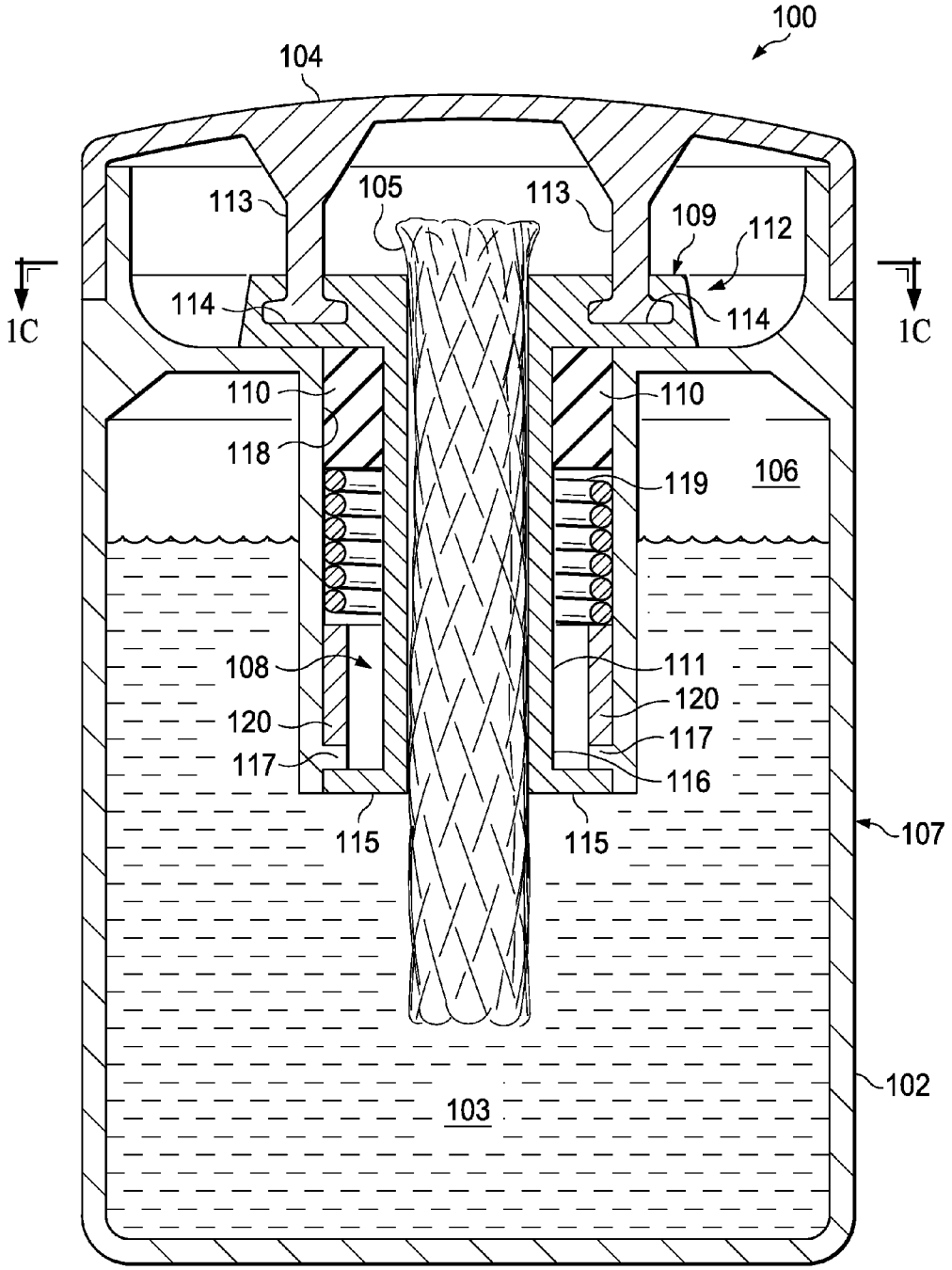
FIG. 1A is a cross-sectional view of a torch according to aspects of the present disclosure.

Referring now to FIG. 1 A, a cross-sectional view of a torch 100 according to aspects of the present disclosure is shown.

The torch 100 includes a tank 102 with an interior 106 and exterior 107. A flammable liquid or fuel 103 is stored on the inside 106 of the tank 102. A wick 105 passes from the inside 106 to the outside 107 of the tank 102. The tank 102 provides a fill opening 108 within a fire vessel 112. The wick 105 draws fuel 103 from the inside 106 of the tank 102 for combustion in the fire vessel 112. The fuel 103 may be lamp oil or another flammable liquid and may include scents and/or repellants such as citronella. The tank 102 and fire vessel 112 may be an integral unit and may be made from a suitably fire resistant material such as rolled steel.

A fill opening 108 is provided in or near the fire vessel 112. In one configuration, the fill opening 108 contains a closing unit 109. In this embodiment, the closing unit 109 comprises a stopper 110 positioned around a portion of a wick holder 111. The stopper may be toroidal or annular in shape. The stopper 110 will substantially seal the inside 106 of the tank 102 from the fire vessel 112 when in the closed position as shown in FIG. 1. The stopper 110 fits against an interior wall 118 of the fill opening 108. The stopper 110 may be made from plastic, rubber, or another suitably heat resistant material.

The wick holder 111 provides a pair of projections 115 that interfit with projections 117 provided by the interior wall 118 of the fill opening 108 to retain the closing unit 109 in the closed position. A spring 119 may be provided that biases the closing unit 109 to create a pop-up effect or operation with opened. Depending upon the depth of the tank 102 and/or the length of the wick 105, a spacer 120 may be provided along the interior wall 118 to hold the spring 119 in the proper location.

The torch may have an operating device 104, such as a lid, which may be manually operated. In the present embodiment, the lid 104 provides two lowering projections 113 that interfit with a pair of recesses 114 on the closing device 109. As shown in FIG. 1B, when the lid 104 is turned (e.g., as shown by the arrow R), the two lower gripping projections 115 on the lowermost part 116 of the wick holder 111 are shifted such that the two lower gripping projections 115 can rise relative to the gripping projections 117 on the inner wall 118 of the filling opening 108. The spring 119 ensures that the wick holder 111 is shifted upward. It can be seen that, when the closing unit 109 is in the open position, the stopper 110 is lifted free from the fill opening 108.

The closing unit 109 may be lifted completely out of the fill opening 108 for refilling the torch 100, or the lid 104 may be removed from the fill unit as described below. The spring 119 will hold the closing unit 109 and stopper 110 sufficiently clear of the fill hole to allow refilling without necessarily removing the closing unit 109. When filling or refilling is complete, the closing unit 109 may be reclosed by reversing the process. In this manner, the stopper 110 is returned to its original position and may prevent accidental spilling of the fuel 103.

Figure 1B:
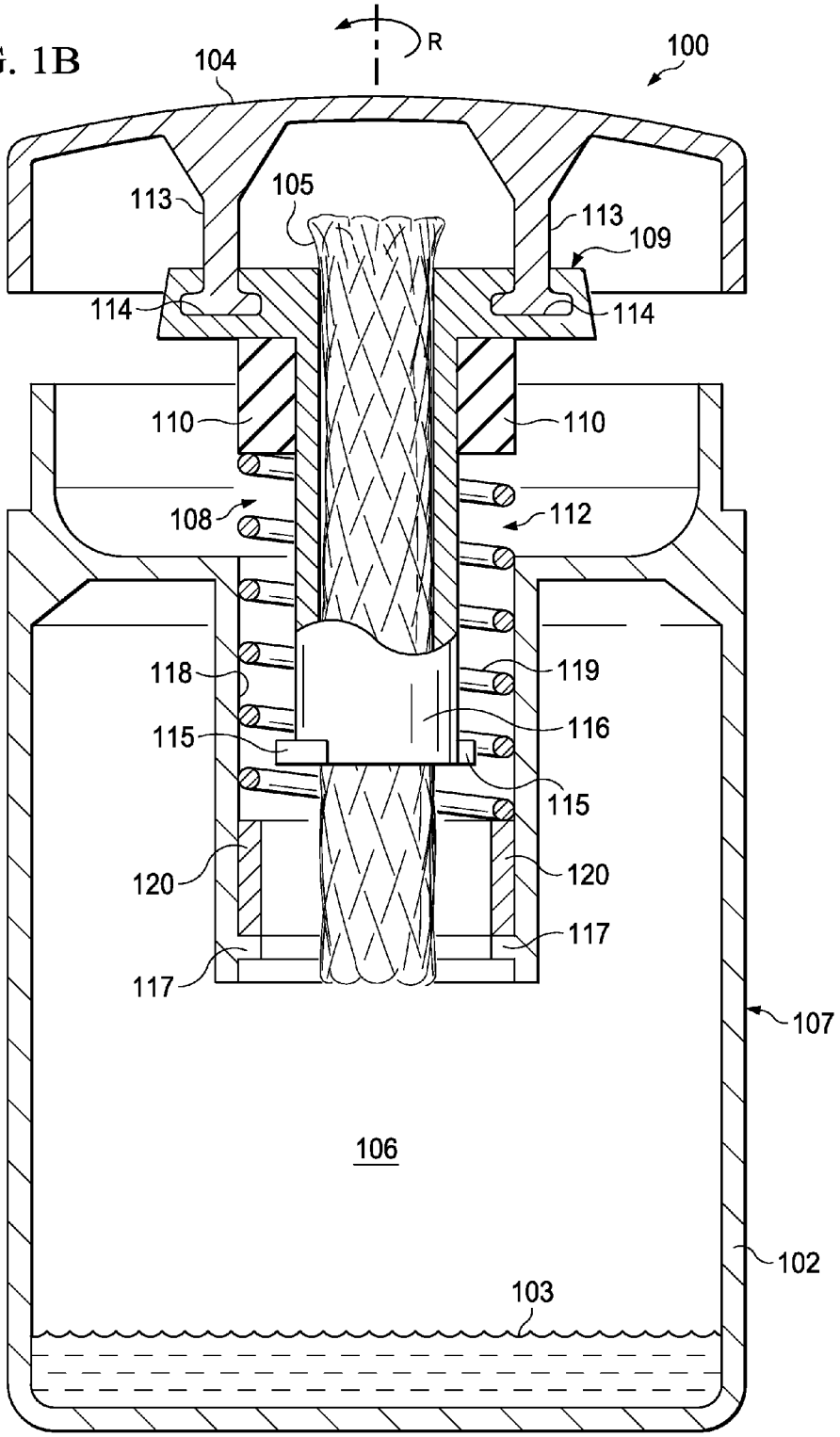
FIG. 1B is a cross-sectional view of the torch of FIG. 1A opened for filling.
Figure 1C:
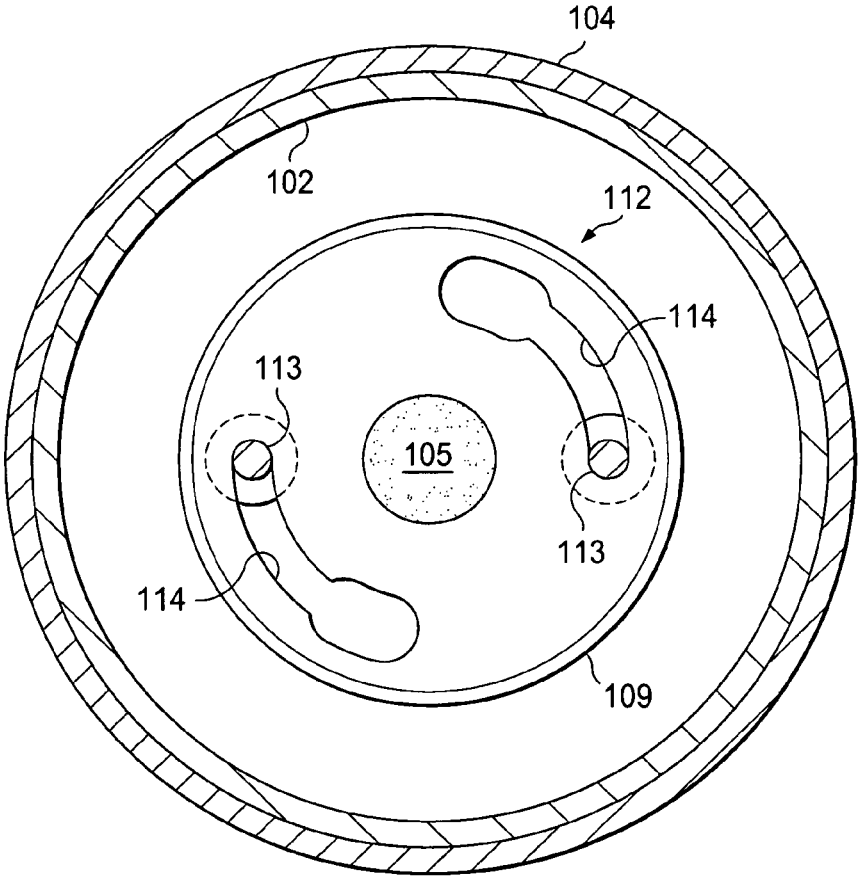
FIG. 1C is a superior cross-sectional of the torch of FIG. 1A taken along the line 1C.

Referring now also to FIG. 1C, a superior cross sectional of the torch of FIG. 1A taken along the line 1C is shown. Here it may be seen how the recesses 114 interfit with the projections 111 of the lid 104. In the present embodiment, the closing unit 109 may be opened or closed by rotating the lid 104 in a clockwise fashion. The lid 104 may be removed from the closing unit 109 by rotations counterclockwise to free the projections 113 from the recesses 114. The lid 104 may be reattached to the closing device 109 by reversing the process. The lid 104 provides also means to extinguish the torch 100.

Figure 2A:
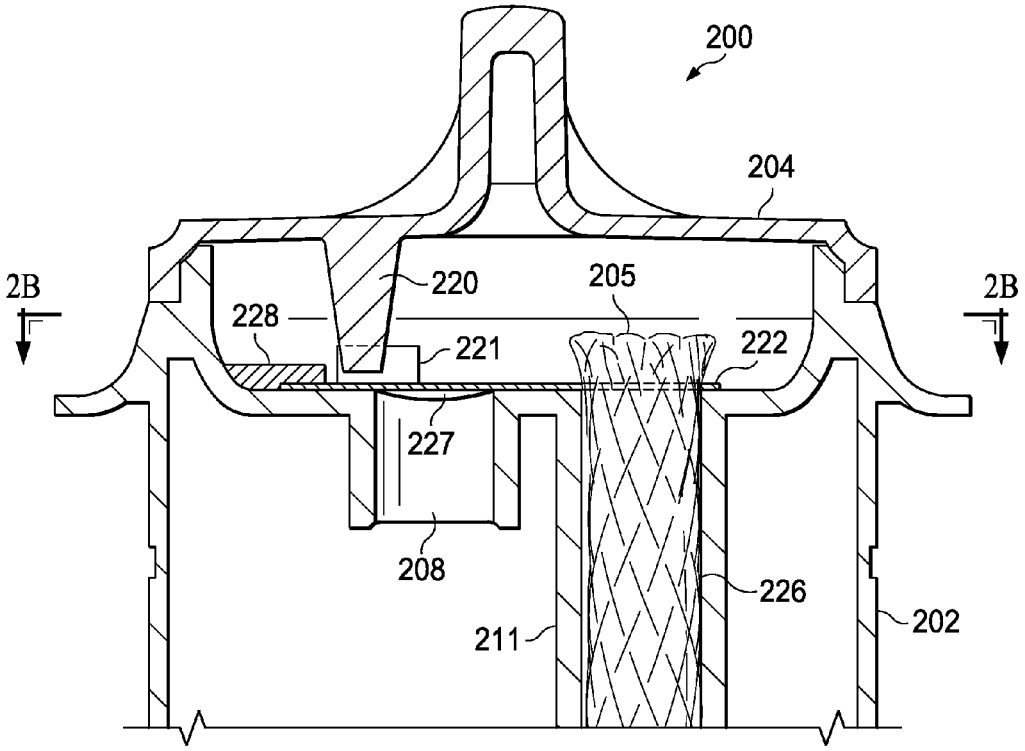
FIG. 2A is a cross-sectional view of another torch according to aspects of the present disclosure.
Figure 2B:
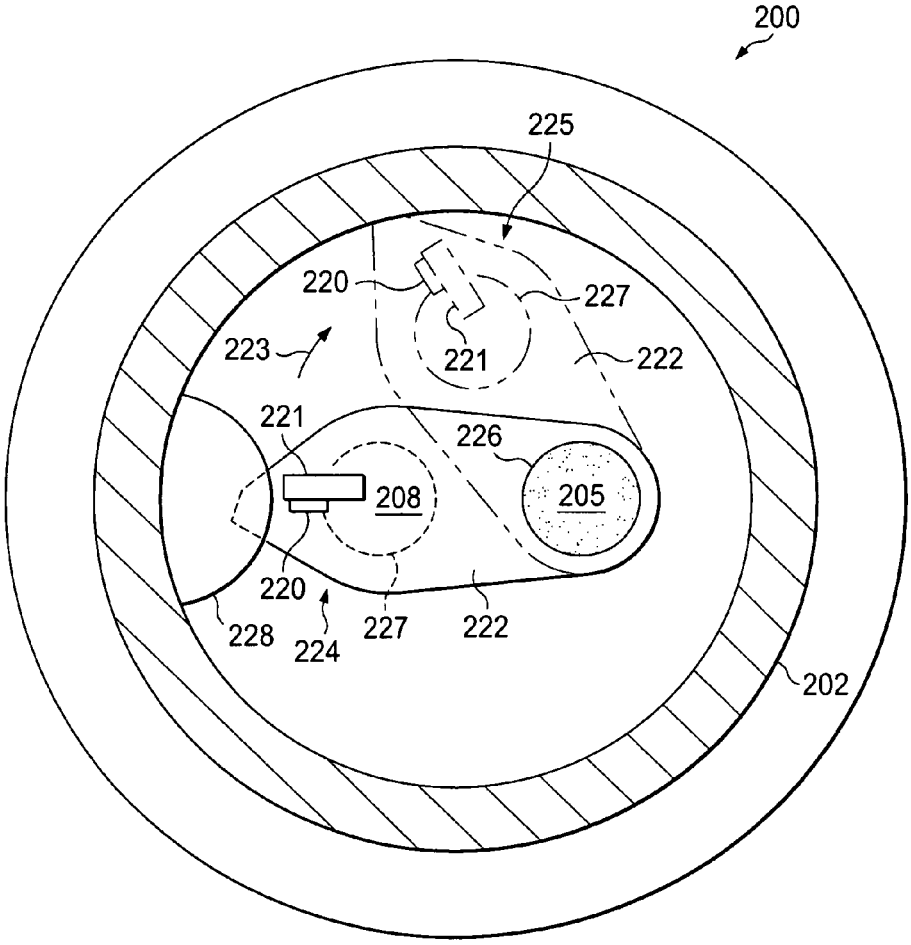
FIG. 2B is a superior view of the torch of FIG. 2A with lid removed.

Referring now to FIG. 2A, a cross-sectional view of another torch according to aspects of the present disclosure is shown. FIG. 2A and an appurtenant sectional plan in FIG. 2B, taken along the line 2B, shows a torch 200 with a lid 204 and a wick 205. The tank and fuel are not shown. The wick 205 is mounted in a wick holder 211, which is a part of a tank 202. The torch 200 in provides a separate filling opening 208. The lid 204 provides a downward pointing projection 220 that may push a corresponding projection 221 onto a rotatable cover 222.

In the embodiment shown, the cover 222 is rotatable in the direction shown by arrow 223 the closed position 224 and an open position 225 (shown in dotted line). In the present embodiment, the point of rotation is near the middle of the wick 205. The wick 205 is shown here sitting in a bushing 226 in the wick holder 211, where the bushing 226 functions as an axle for the rotation the cover 222. The cover 222 of the present embodiment provides a sealing protrusion 227 that seals the filling opening 208 when the cover 222 is in the closed position 224. A locking cam 228 may ensure that extra pressure is put on the cover 222 when this is in the closed position 224. As with previous embodiments, the lid 204 may also be used as a snuffer for extinguishing the wick 205.

Figure 3A:
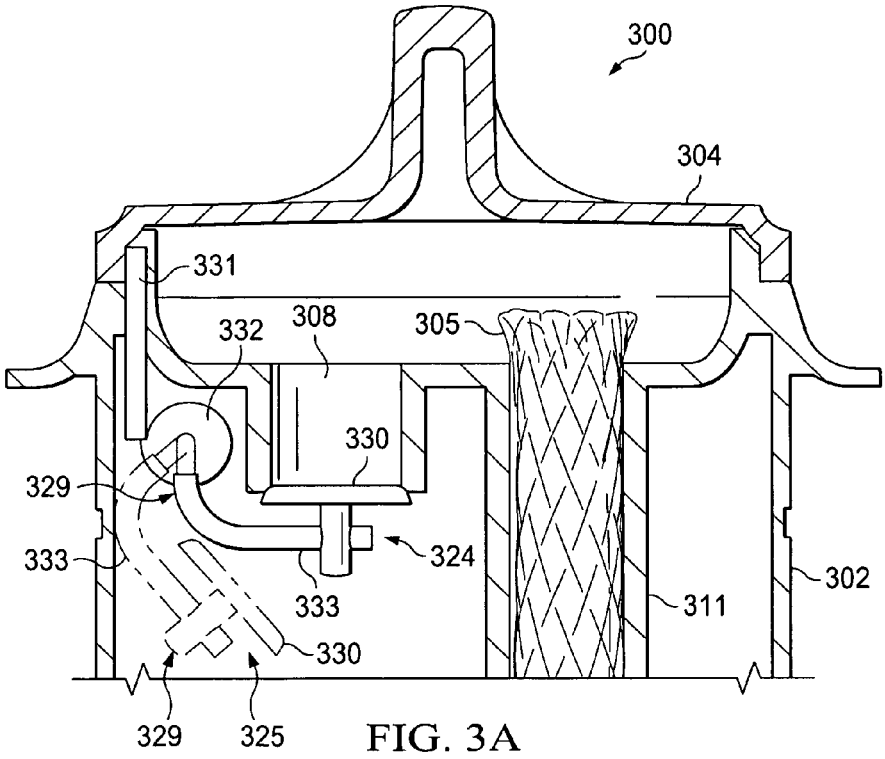
FIG. 3A is a cross-sectional view of another torch according to aspects of the present disclosure.

Referring now to FIG. 3A a cross sectional view of another torch according to aspects of the present disclosure is shown. As with previous designs, the torch 300 has a lid 304 and a wick 305 mounted in a wick holder 311, which may be a part of the tank 302. A separate filling opening 308 has a closing unit 329. In the present embodiment, the closing unit 329 includes a stopper 330 mounted on an arm 333. The closing unit 329 can be turned away from the opening such that the stopper 330 moves from being in a closed position 324 to being in an open position 325 (indicated with dashed lines).

In order for the closing unit 329 to move from the closed position 324 to the open position 325, the lid 304 must be placed on the tank 302. A safety pin device 331 is mounted in a biased position to mesh with an axle 332, about which the closing unit rotates. When the lid 304 is placed on the tank 302, the lid presses on the safety pin 331 and moves it away from the axle 332. The shape and flexibility of the pin 331 may provide the appropriate bias or a spring (not shown) may be provided.

Figure 3B:
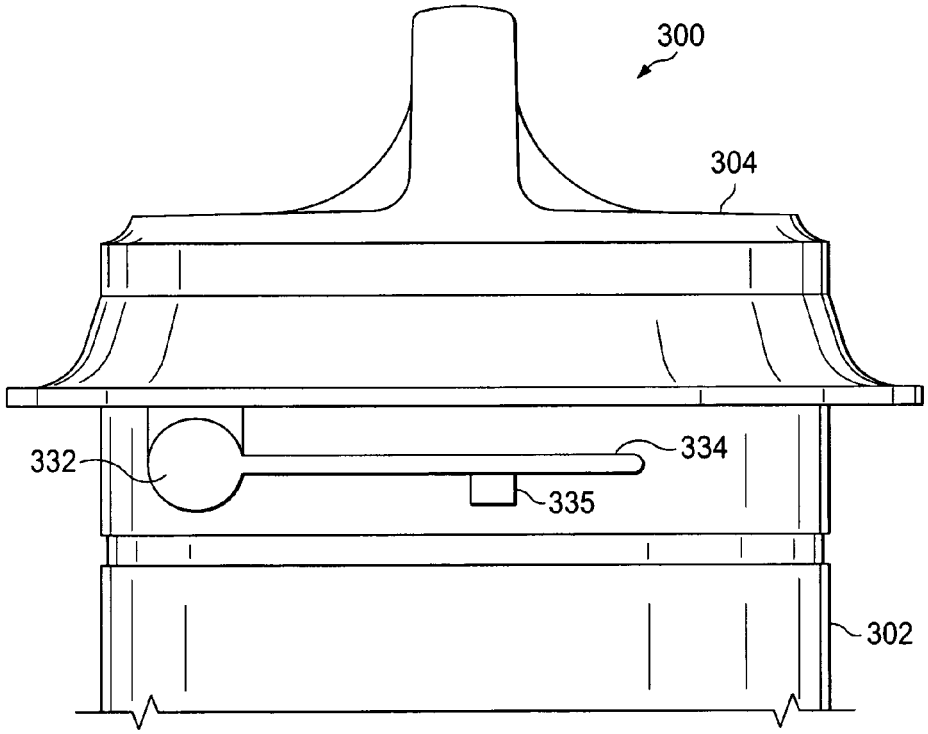
FIG. 3B is a side view of the torch of FIG. 3A.

Referring now to FIG. 3B, it can be seen that the axle 332 leads out through the side of the tank 302 and is mounted with a lever 334. An external pin 335 holds the lever 334 such that the stopper 330 is held in the closed position 324. The lever 334 may be flexed and moved over the pin 335 to allow the closing unit 329 to be opened (when the lid 304 is attached as described above) by moving the lever 334 downward.

The torches of the present disclosure may be used for a variety of purposes such as decorative lighting and dispersing scented oils. The torches may also be used to disperse insect repellant oils and/or chemicals. In some embodiments, the torches may be used alone by placing in a desired location and lighting. In other embodiments, decorative containers or poles may be used to enhance the appearance and/or utility of the torches. The torches may be used as table-top torches, patio torches, or may be used as pole-mounted lawn torches among other uses.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A torch comprising:

a tank defining a wick holder and a fill hole separate from the wick holder, the wick holder and fill hole being atop the tank and opening into a fire vessel atop the tank;

a closing device that seals the fill hole from inside the tank when in a closed position, the closing device being operable by an attached lever that is external to the tank and apart from the fire vessel; and a safety pin biased to prevent opening of the closing device.

2. The torch of claim 1, further comprising an axle interposing the closing device and the external lever, wherein the safety pin meshes with the axle to prevent opening of the closing device.

3. The torch of claim 2, further comprising a lid fitted to the tank that is operable as a snuffer and disengages the safety pin from the axle when placed on the tank.

4. The torch of claim 2, wherein closing device further comprises a stopper mounted to an arm, the arm connecting to an axle that meshes with the safety pin such that the safety pin selectively prevents rotation of the axle.

* * * * *